United States Patent [19]

Yamazaki

[11] Patent Number: 4,808,890

[45] Date of Patent: Feb. 28, 1989

[54] CATHODE-RAY TUBE

[75] Inventor: Eiichi Yamazaki, Ichihara, Japan

[73] Assignee: Hitachi, Ltd., Tokyo, Japan

[21] Appl. No.: 895,915

[22] Filed: Aug. 13, 1986

[30] Foreign Application Priority Data

Sep. 20, 1985 [JP] Japan ..... 60-206407

[51] Int. Cl.[4] ..... H01J 29/70; H01J 29/76

[52] U.S. Cl. ..... 315/366; 313/422; 313/423

[58] Field of Search ..... 315/366; 313/422, 423, 313/432, 439

[56] References Cited

U.S. PATENT DOCUMENTS

| | | | |
|---|---|---|---|
| 2,332,876 | 10/1943 | Uhlmann . | |
| 2,728,025 | 12/1955 | Weimer | 313/423 |
| 2,864,033 | 12/1958 | Aiken | 313/423 |
| 2,880,365 | 3/1959 | Law et al. | 315/366 |
| 2,965,801 | 12/1960 | Archer et al. | 313/422 |
| 3,080,500 | 3/1963 | Preston | 313/423 |
| 3,794,876 | 2/1974 | Van Alphen | 313/432 |
| 3,890,541 | 6/1975 | McCarthy et al. | 313/422 |

FOREIGN PATENT DOCUMENTS

| | | |
|---|---|---|
| 1354682 | 5/1974 | United Kingdom . |
| 2133211 | 7/1984 | United Kingdom . |

OTHER PUBLICATIONS

Patent Abstracts of Japan, Unexamined Applications, E Section, vol. 9, No. 270, 10-26-85, p. 75, E 353.

*Primary Examiner*—Theodore M. Blum

*Attorney, Agent, or Firm*—Antonelli, Terry & Wands

[57] ABSTRACT

A cathode-ray tube having an electron gun for emitting an electron beam and a reflecting electrode for forming in front thereof a substantially planar reflecting potential surface which reflects the electron beam from the electron gun toward an anode target formed on the inner surface of the tube.

14 Claims, 4 Drawing Sheets

CATHODE-RAY TUBE

BACKGROUND OF THE INVENTION

This invention relates to a cathode-ray tube having a reflecting potential surface for reflecting toward a phosphor screen an electron beam which is emitted from an electron gun, and more particularly to an electrode structure for formation of the reflecting potential surface.

A cathode-ray tube of this type has hitherto been proposed wherein an electron gun is disposed sidewise of a phosphor screen and a reflecting potential surface for reflecting toward the phosphor screen an electron beam emitted from the electron gun and deflected by a deflector is configured into a form of convexly curved surface, in order that the deflection angle can be increased and the overall length of a bulb can be reduced.

Since the cathode-ray tube constructed as above has the convexly curved reflecting potential surface for reflecting the deflected electron beam toward the phosphor screen, the deflection, on one hand, can advantageously be amplified to a great extent but the size or diameter of a beam spot, on the other hand, is concurrently increased to disadvantageously degrade a focus characteristic.

SUMMARY OF THE INVENTION

An object of this invention is to provide a cathode-ray tube which can exhibit an excellent focus characteristic while attaining the reduction in the overall length of a bulb.

To accomplish the above object, according to the invention, the reflecting potential surface is made substantially planar.

DESCRIPTION OF THE PREFERRED EMBODIMENTS

The invention will now be described by way of example with reference to the accompanying drawings.

Figure 1:
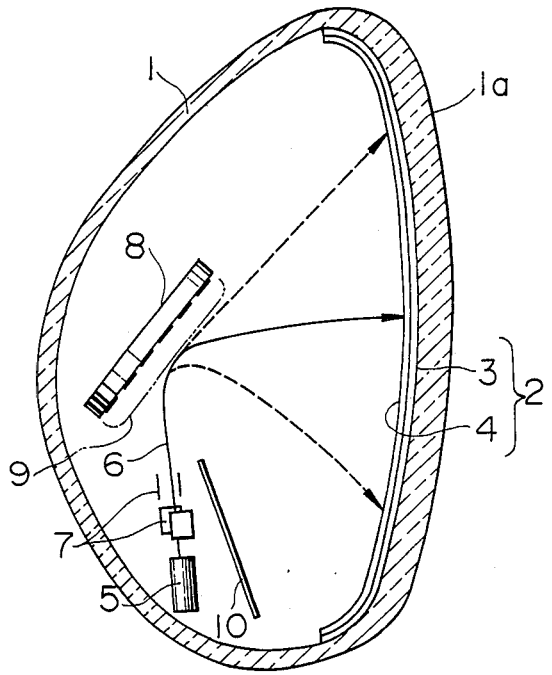
FIG. 1 is a sectional view showing a cathode-ray tube according to an embodiment of the invention.

FIG. 1 is a sectional view showing the essential part of a cathode-ray tube according to an embodiment of the invention. Referring to FIG. 1, the cathode-ray tube comprises a glass bulb 1 including a glass faceplate 1*a*, an anode target 2 comprised of a phosphor film 3 coated on the inner surface of the glass faceplate 1a and an aluminum film 4 vapor-deposited on the back surface of the film 3, an electron gun 5 fixedly supported within the glass bulb 1 at the bottom thereof, a reflecting electrode 8 for forming a frontal zero potential planar reflecting surface 9 which reflects an electron beam 6 toward the anode target 2, and a shielding plate 10 maintained at the same potential as that of the anode target 2 to guard against disturbance of electric field due to the electron gun 5.

With this construction, the electron beam 6 emitted from the electron gun 5 is reflected at the zero potential planar reflecting surface 9 formed in front of the reflecting electrode 8 so as to be scanned toward the anode target 2. As shown in FIG. 1, a deflector 7 for deflecting the electron beam may be provided in order to direct or introduce the electron beam from the electron gun 5 to the planar reflecting electrode 8.

Figure 2:
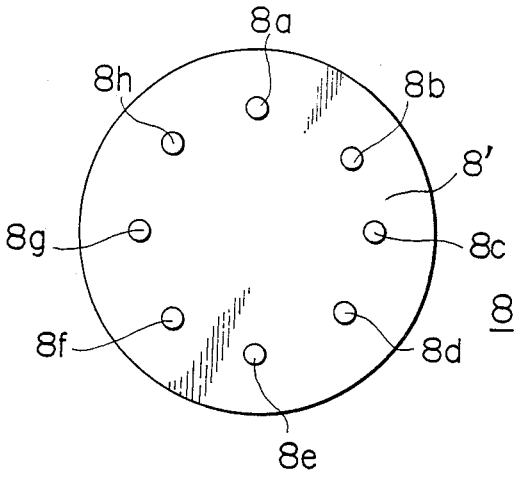
FIG. 2 is an enlarged plan view showing a reflecting electrode of FIG. 1.
Figure 3:
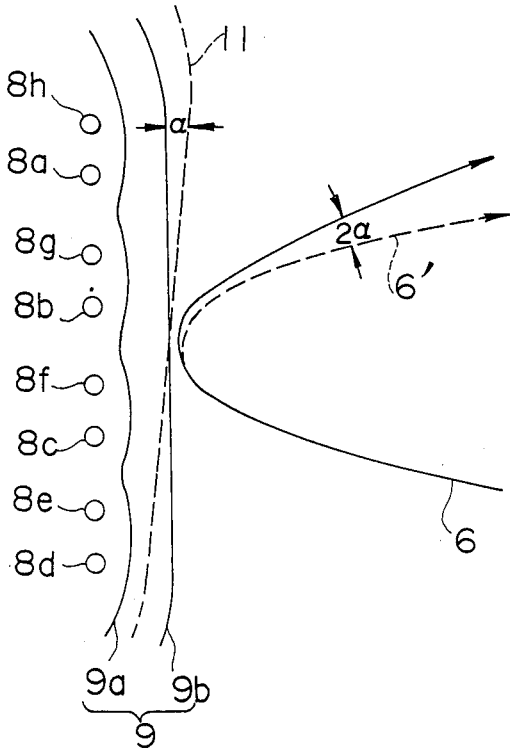
FIG. 3 is a diagram for explaining the operation of the reflecting electrode.
Figure 4:
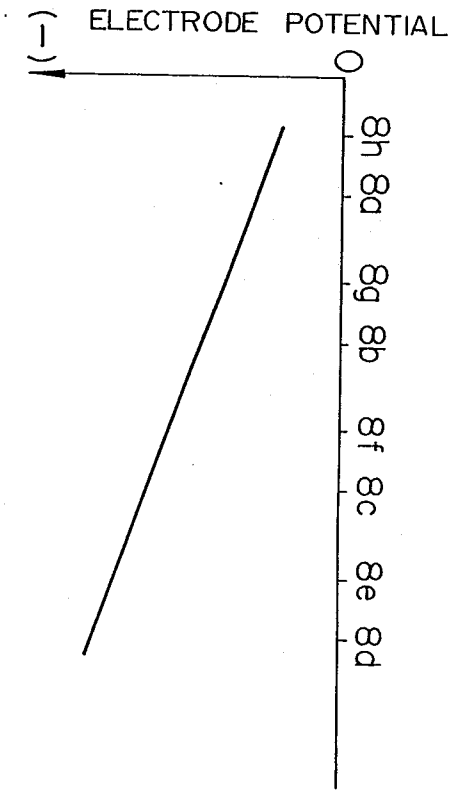
FIG. 4 is a graph showing a potential gradient applied to the reflecting electrode.

The reflecting electrode 8 has, as shown in plan view in FIG. 2, a plurality of, for example, eight dot-like elemental electrodes 8*a*, 8*b*, 8*c*, 8*d*, 8*e*, 8*f*, 8*g* and 8*h* which are formed on a disc-like insulating substrate 8' circumferentially along the periphery thereof at predetermined angular spacings. When the respective dot-like elemental electrodes 8*a* to 8*h* of the reflecting electrode 8 are applied with identical potential which is negative relative to the cathode potential, the zero potential reflecting surface 9, as illustrated from FIG. 3 showing a side view of the FIG. 2 electrode, is formed which contains an equipotential line 9*a* or 9*b* substantially parallel to a surface defined by an array of the dot-like elemental electrodes 8*a* to 8*h*. The electron beam 6 incident to the zero potential reflecting surface 9 is reflected at a reflection angle substantially equal to an angle of incidence to the surface 9. When the dot-like elemental electrodes 8*a* to 8*h* are applied with different levels of voltage in the order of arraying at a potential gradient as exemplified in FIG. 4, a zero potential reflecting surface 11 now formed is inclined as shown at dotted line in FIG. 3 with respect to the array surface of the dot-like elemental electrodes 8*a* to 8*h* and an electron beam 6 incident to this zero potential reflecting surface 11 is reflected at a reflection angle substantially equal to an angle of incidence to the surface 11, as indicated by a beam 6'. Assuming that the zero potential reflecting surface 11 inclines by an angle of a $\alpha$ from the zero potential reflecting surface 9, the scanned angle of the reflected electron beam 6' is increased by $2\alpha$. Accordingly, by differently varying the levels of voltages applied to the individual dot-like elemental electrodes 8*a* to 8*h* to provide a desired potential gradient, the orientation of the zero potential reflecting surface per se can be varied to scan the electron beam 6 correspondingly. For example, in order to scan the incoming electron beam by 90°, the inclination angle $\alpha$ of the zero potential reflecting surface is set to be $\pm 22.5\alpha$. In addition, by modulating the potential gradient with the vertical and horizontal deflection frequencies, the electron beam reflected at the zero potential reflecting surface can scan the entire screen. In this case, the application of voltage levels which is required for establishing a requisite potential gradient to the respective dot-like elemental electrodes 8*a* to 8*h* suffices, and hence there is no need of supplying a considerably large amount of power which is otherwise required for deflection per se of the electron beam.

Since the zero potential reflecting surface 9 or 11 formed by the reflecting electrode 8 in accordance with this invention is substantially planar, the spot diameter of the electron beam 6 reflected by the zero potential reflecting surface is not enlarged so that a beam spot of high quality can be obtained.

Figure 5:
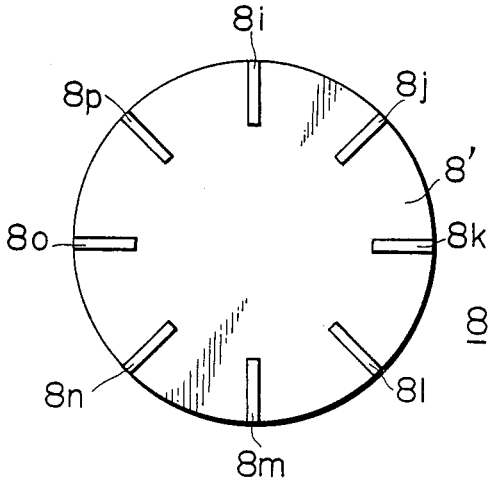
FIGS. 5 to 7 are plan views showing other embodiments of the reflecting electrode.

In the embodiment described hereinbefore, the reflecting electrode 8 has a plurality of dot-like elemental electrodes 8*a* to 8*h* which are arranged circumferentially on the insulating substrate 8'. But, the invention is not limited to this configuration. In another embodiment of the reflecting electrode, rod-like elemental electrodes 8i to 8p are used as shown in FIG. 5. Further, in addition to the circular arrangement of the elemental electrodes described previously, the elemental electrodes of the reflecting electrode may be arranged to take other shapes, for example,such as a square, rectangular or polygonal contour, thereby producing, in effect, the same results as those of the above described embodiments.

Figure 6:
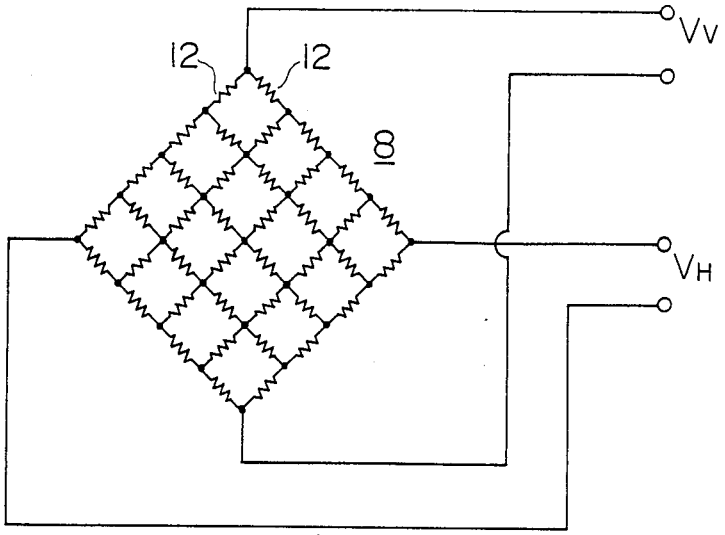
Figure 7:
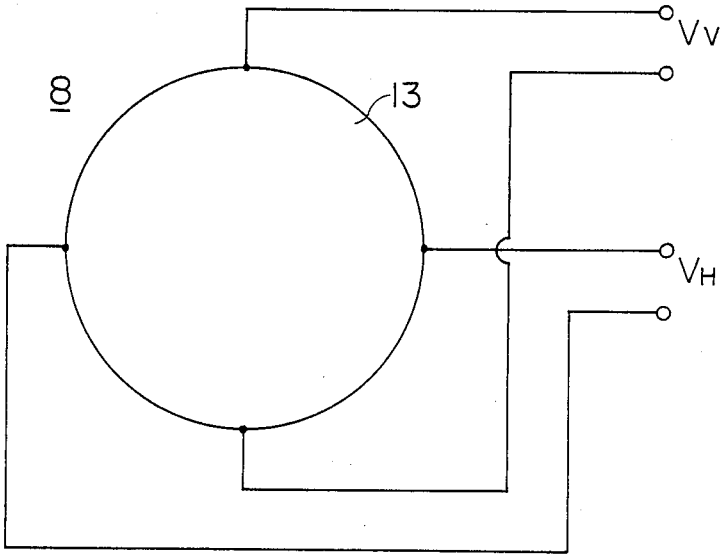

In further embodiments, the reflecting electrode 8 may consist of a number of resistors 12 interconnected in a mesh configuration as shown in FIG. 6 or it may consist of a circular shaped resistor-coated layer (resistor sheet) 13 as shown in FIG. 7. In the embodiment shown in FIG. 6, a horizontal deflection voltage $V_H$ modulated with the horizontal deflection frequency is applied across portions of the reflecting electrode 8 corresponding to diagonally opposite resistor end terminals, and a vertical deflection voltage $V_V$ modulated with the vertical deflection frequency is applied across the other portions that are located at diagonally opposite resistor end terminals. In the embodiment shown in FIG. 7, also, similar horizontal and vertical deflection voltages $V_H$ and $V_V$ are applied to the reflecting electrode 8 in a similar manner. In the embodiments of FIGS. 6 and 7, the zero potential reflecting surface is smoothed and its geometrical shape can be controlled freely, as compared to the zero potential reflecting surface obtained with the reflecting electrode 8 having the dot-like elemental electrodes 8a to 8h.

In the foregoing embodiments, the reflecting electrode as applied to a monochromatic cathode-ray tube has been described for illustration purpose only, but obviously, the invention may also be applied to various types of cathode-ray tubes such as of the shadow mask type, beam index type and penetration type cathode-ray tubes to attain the same effects as those described hereinbefore.

As described above, according to the invention, by constructing the reflecting electrode such that the electron beam emitted from the electron gun can be reflected toward the anode target by the substantially planar zero potential reflecting surface, the high-quality beam spot size can be obtained. Advantageously, the present invention can therefore provide the cathode-ray tube which can exhibit an excellent focus characteristic while attaining the reduction in the overall length of a bulb.

I claim:

1. A cathode-ray tube in a bulb comprising:

an anode target region formed on the inner surface of said bulb;

an electron gun for emitting an electron beam; and a reflecting electrode for generating a planar reflecting electro-potential surface which reflects the electron beam from said electron gun, said electrode being positionally disposed to directly face both an oncoming electron beam emitted from said electron gun and said anode target and including a plurality of resistors interconnected in a mesh configuration, and wherein controllable potential levels are applied across a plurality of pairs of diagonally opposite resistor terminal portions of said mesh configuration for generating a planar reflecting electro-potential surface having a controllable orientation with respect to the face of said reflecting electrode so as to effect scanning of said electron beam over the entire anode target region from said planar reflecting potential surface.

2. A cathode-ray tube in a bulb comprising:

an anode target region formed on the inner surface of said bulb;

an electron gun for emitting an electron beam; and a reflecting electrode for generating a planar reflecting electro-potential surface which reflects the electron beam from said electron gun, said electrode being positionally disposed to directly face both an oncoming electron beam emitted from said electron gun and said anode target and including a sheet resistor, and wherein controllable potential levels are applied across a plurality of pairs of diametrically opposite portions along the periphery of said sheet resistor for generating a planar reflecting electro-potential surface having a controllable orientation with respect to the face of said reflecting electrode so as to effect scanning of said electron beam over the entire anode target region from said planar reflecting potential surface.

3. A cathode-ray tube in a bulb comprising:

an anode target region formed on the inner surface of said bulb;

an electron gun for emitting an electron beam; and a reflecting electrode for generating a planar reflecting electro-potential surface which reflects the electron beam from said electron gun, said electrode being positionally disposed to directly face both an oncoming electron beam emitted from said electron gun and said anode target and including eight elemental electrodes arranged on a disc-shaped insulating means circumferentially along the periphery thereof and at predetermined angular intervals and applied with controllable potential levels, the potential levels corresponding to said elemental electrodes being controlled to effect in a potential gradient at said reflecting electrode for generating a planar reflecting electro-potential surface having a controllable orientation with respect to the surface of said reflecting electrode so as to effect scanning of said electron beam over the entire anode target region from said planar reflecting potential surface.

4. A cathode-ray tube according to claim 3, wherein said elemental electrodes comprise dot-shaped elemental electrodes.

5. A cathode-ray tube according to claim 3, wherein elemental electrodes comprise rod-shaped elemental electrodes.

6. A cathode-ray tube, formed in a bulb, comprising:

an anode electrode region formed as a target on the inner surface of said bulb;

electron gun means for emitting an electron beam; and a reflecting electrode for generating a planar reflecting electro-potential surface which reflects the electron beam emitted from said electron gun so as to allow said electron beam to be scanned from said surface over said anode electrode target region, including eight elemental electrodes, arranged on a disc-shaped insulating means circumferentially along the periphery thereof and at predetermined angular intervals,and having controllable potential levels applied to each one for varying the angular orientation of said planar reflecting electro-potential surface with respect to the face of said reflecting electrode.

7. A cathode-ray tube according to claim 6, wherein said elemental electrodes comprise dot-shaped elemental electrodes.

8. A cathode-ray tube according to claim 6, wherein elemental electrodes comprise rod-shaped elemental electrodes.

9. A cathode-ray tube, formed in a bulb, comprising:

an anode electrode as the target formed on the inner surface of said bulb;

electron gun means for emitting an electron beam; and a reflecting electrode for forming a planar reflecting electro-potential surface which reflects the electron beam from said electron gun so as to allow said electron beam to be scanned from said surface over said anode electrode target, including a plurality of resistors interconnected in a mesh configuration which have controllable potential levels applied across respective pairs of diagonally opposite resistor terminal portions of said mesh configuration for varying the orientation of said planar reflecting electro-potential surface to a desired angle with respect to the face of said reflecting electrode.

10. A cathode-ray tube according to claim 9, wherein said planar reflecting potential surface is a zero potential planar reflecting surface.

11. A cathode-ray tube according to claim 9, wherein said controllable potential levels correspond to the horizontal and vertical deflections voltages.

12. A cathode-ray tube, formed in a bulb, comprising:

an anode electrode as the target formed on the inner surface of said bulb;

electron gun means for emitting an electron beam; and a reflecting electrode for forming a planar reflecting electro-potential surface which reflects the electron beam from said electron gun so as to allow said electron beam to be scanned from said surface over said anode electrode target, including a sheet resistor having controllable potential levels applied across respective pairs of diametrically opposite portions along the periphery of said sheet resistor in order to vary the angular orientation of said planar reflecting potential surface with respect to said reflecting electrode.

13. A cathode-ray tube according to claim 12, wherein said planar reflecting potential surface is a zero potential planar reflecting surface.

14. A cathode-ray tube according to claim 12, wherein said controllable potential levels correspond to the horizontal and vertical deflection voltages.

* * * * *